US009127868B2

(12) United States Patent
Iwasawa et al.

(10) Patent No.: US 9,127,868 B2
(45) Date of Patent: Sep. 8, 2015

(54) HEAT EXCHANGER AND A HEAT PUMP USING SAME

(75) Inventors: Naotaka Iwasawa, Isesaki (JP); Yukio Yamaguchi, Isesaki (JP); Hirotaka Kado, Isesaki (JP)

(73) Assignee: SANDEN CORPORATION, Gunma (JP)

( * ) Notice: Subject to any disclaimer, the term of this patent is extended or adjusted under 35 U.S.C. 154(b) by 365 days.

(21) Appl. No.: 13/701,295

(22) PCT Filed: May 30, 2011

(86) PCT No.: PCT/JP2011/062359

§ 371 (c)(1),
(2), (4) Date: Nov. 30, 2012

(87) PCT Pub. No.: WO2011/152343

PCT Pub. Date: Dec. 8, 2011

(65) Prior Publication Data

US 2013/0111945 A1 May 9, 2013

(30) Foreign Application Priority Data

May 31, 2010 (JP) ..... 2010-123861

(51) Int. Cl.

*F25B 39/02* (2006.01)
*F28F 1/32* (2006.01)
*F28D 1/053* (2006.01)

(52) U.S. Cl.

CPC ..... *F25B 39/02* (2013.01); *F28D 1/053* (2013.01); *F28F 1/32* (2013.01)

(58) Field of Classification Search

CPC ..... F25B 39/02; F25B 39/022; F25B 13/00; F28F 1/325

USPC ..... 62/515, 324.1; 165/151, 173, 182

See application file for complete search history.

(56) References Cited

U.S. PATENT DOCUMENTS 5,076,354 A * 12/1991 Nishishita ..... 165/146
5,441,106 A * 8/1995 Yukitake ..... 165/183
6,000,467 A * 12/1999 Tokizaki et al. ..... 165/134.1

(Continued)

FOREIGN PATENT DOCUMENTS

EP 0 936 432 8/1999
JP 10-207926 8/1998

(Continued)

OTHER PUBLICATIONS

Search Report dated Sep. 17, 2013 issued in the corresponding European Patent Application No. 11 78 9746.2.

*Primary Examiner* — Melvin Jones
(74) *Attorney, Agent, or Firm* — Cozen O'Connor

(57) ABSTRACT

A heat exchanger having a plurality of heat-transfer tubes arrayed at intervals in vertical and anteroposterior directions and arranged so that an equilateral triangle is formed by lines connecting the centers of heat-transfer tubes located vertically and anteroposteriorly adjacent to each other; and a plurality of heat-transfer corrugated fins arranged at intervals in an axial direction of the heat-transfer tubes, characterized in that when an external diameter of each of the heat-transfer tubes is V1; a vertical pitch of the heat-transfer tubes is V2, a fin pitch of the heat-transfer corrugated fins is V3, a fin plate thickness of each of the heat-transfer corrugated fins is V4, and a corrugate height of the heat-transfer corrugated fins is V5, any one of V2, V3 and V5 is set within a given range.

4 Claims, 10 Drawing Sheets

(56) References Cited

U.S. PATENT DOCUMENTS

| | | | | |
|---|---|---|---|---|
| 6,062,303 | A * | 5/2000 | Ahn et al. | 165/110 |
| 6,189,607 | B1 * | 2/2001 | Hosoya et al. | 165/174 |

FOREIGN PATENT DOCUMENTS

| | | |
|---|---|---|
| JP | 2000-274982 | 10/2000 |
| JP | 2003-314978 | 11/2003 |
| JP | 2004-311885 | 11/2004 |
| JP | 2005-009827 | 1/2005 |
| WO | WO 03/073023 | 9/2003 |
| WO | WO 2009/104439 | 8/2009 |
| WO | WO 2010/016615 | 2/2010 |

* cited by examiner

HEAT EXCHANGER AND A HEAT PUMP USING SAME

RELATED APPLICATIONS

This is a U.S. National Phase Application under 35 USC 371 of International Application PCT/JP2011/062359 filed on May 30, 2011.

This application claims the priority of Japanese application no. 2010-123861 filed May 31, 2010, the entire content of which is hereby incorporated by reference.

TECHNICAL FIELD

The invention relates to a heat exchanger that makes heat exchange between refrigerant and gas, such as air, for air-conditioning, freezing, cold storage, hot-water supply, etc., and more specifically, to a heat exchanger installed in a refrigerating circuit using a carbon dioxide refrigerant and to a heat pump using the heat exchanger.

BACKGROUND ART

In late years, along with demands for high performance and downsizing of apparatus to which heat exchangers of the above-mentioned type are applied, the heat exchangers have been required to be increased in heat exchange amount and further reduced in size and weight. For that reason, a fin tube-type heat exchanger improved in these matters is suggested (see Patent Documents 1 and 2, for example).

The heat exchanger disclosed in Patent Document 1 includes a plurality of plate-like fins arranged parallel to each other, and allow gas to flow therebetween; heat-transfer tubes with an external diameter D (3 mm≤D≤7 mm), which are perpendicularly inserted into the plate-like fins and allows working fluid to flow inside thereof, the tubes being arranged in rows in a row direction perpendicular to a gas-passing direction and also arranged in lines in a line direction that is the gas-passing direction; and cuts provided in faces of the plate-like fins and having openings opposed to the gas flow. A row pitch Dp in the row direction of the heat-transfer tubes is set in a range of 2D≤Dp≤3D. A line pitch Lp in the line direction of the heat-transfer tubes is set in a range of 2D≤Lp≤3.5D. A fin pitch Fp of the plate-like fins is set in a range of 0.5D≤Fp≤0.7D. This makes it possible to materialize a heat exchanger that is low in ventilation resistance and good in heat-transfer performance.

Patent Document 2 refers to a fin tube-type heat exchanger having a number of fins that are arranged at intervals substantially parallel to each other and allow fluid A to flow through spaces therebetween, and a number of heat-transfer tubes that are substantially perpendicularly inserted into the fins and allow fluid B flows inside thereof. Carbon dioxide is used as the fluid B of the fin tube-type heat exchanger in which an external diameter D of each the heat-transfer tubes is set in a range of 1 mm≤D<5 mm, a tube line pitch L1 in a flowing direction of the fluid A of the heat-transfer tubes is set in a range of 2.5D<L1≤3.4D, and a tube row pitch L2 in a perpendicular direction to the flowing direction of the fluid A is set in a range of 3.0D<L2≤3.9D. As a consequence, it is possible to provide a compact and high-voltage heat exchanger in which the balance of heat exchange amount and frost formation resistance is good, as compared to conventional fin tube-type heat exchangers. Furthermore, since carbon dioxide is used as the fluid B, the refrigerant is high-pressure and high-density. Pressure loss in the heat-transfer tubes therefore affects temperature change only a little, so that a large amount of heat exchange can be obtained.

PRIOR ART DOCUMENT

Patent Document

Patent Document 1: Unexamined Japanese Patent Publication (Kokai) No. 2000-274982

Patent Document 2: Unexamined Japanese Patent Publication (Kokai) No. 2005-9827

SUMMARY OF THE INVENTION

Problems to be Solved by the Invention

In the aim of providing the heat exchanger having a good heat-transfer performance, Patent Document 1 sets the external diameter D of the heat-transfer tubes, the values of the row pitch Dp in the row direction of the heat-transfer tubes, the line pitch Lp in the line direction of the heat-transfer tubes, and the fin pitch Fp of the plate-like fins to fall within their respective given ranges. For example, the value of the row pitch is used as a parameter of the row pitch, whereas the other values do not necessarily fall within optimum ranges and are determined to be fixed values by calculating the heat exchange amount. Accordingly, relationship between the row pitch and the heat exchange amount when the other fixed values are changed is not clear. When the other fixed values are changed, it is unclear whether or not the heat exchange amount is large while the row pitch falls in the given range.

To provide a fin tube-type heat exchanger in which there is a sufficiently good balance between heat exchange amount and frost formation resistance, Patent Document 2 sets the tube line pitch L1 to be 2.5D<L1≤3.4D, and the tube row pitch L2 to be 3.0D<L2≤3.9D while the tube external diameter D falls in a range of 1 mm≤D<5 mm. The fin pitch and fin plate thickness, which are constituents of the heat exchanger, have an influence on the heat exchange amount of the heat exchanger. Since the Patent Document 2 does not include the parameters of the fin pitch and the fin plate thickness, it is unclear whether a proper heat exchange amount can be obtained simply by a combination of the tube external diameter D, the tube line pitch L1 and the tube row pitch in the given ranges. What is also unclear is the range setting of the tube external diameter D, the tube line pitch L1 and the tube row pitch L2 when the parameters of the fin pitch and the fin plate thickness are changed.

In other words, the prior art documents are on the premise that the external diameter of the heat-transfer tubes, the pitch of the heat-transfer tubes, the fin pitch of the plate-like fins and the like can be independently optimized. In fact, however, there is a certain relationship between the parameters with respect to the heat exchange amount, so that the optimum value of each parameter is determined by the other parameters.

It is not clear from the prior art documents as to how the parameters are determined to materialize the heat exchanger that provides the best heat exchange amount. Furthermore, considering costs for producing the heat exchanger and workability in installing the heat exchanger in a heat pump, the heat exchange amount per unit weight is also an important factor. However, the prior art does not refer to the heat exchange amount per unit weight.

The present invention has been made in light of the above problems. It is an object of the invention to provide a compact and lightweight heat exchanger that provides the best heat exchange amount by determining parameters' optimum values that exert heat exchange performance per unit weight of a fin tube-type heat exchanger to the utmost extent, in consideration of relationship between the parameters, and a heat pump using the heat exchanger.

Means for Solving the Problems

In order to achieve the object, the present invention provides a heat exchanger having a plurality of heat-transfer tubes arrayed at intervals in vertical and anteroposterior directions and arranged so that an equilateral triangle is formed by lines connecting the centers of heat-transfer tubes located vertically and anteroposteriorly adjacent to each other; and a plurality of heat-transfer corrugated fins arranged at intervals in an axial direction of the heat-transfer tubes, the heat exchanger being characterized in that, when an external diameter of each of the heat-transfer tubes is V1, a vertical pitch of the heat-transfer tubes is V2, a fin pitch of the heat-transfer corrugated fins is V3, a fin plate thickness of each of the heat-transfer corrugated fins is V4, and a corrugate height of the heat-transfer corrugated fins is V5, any one of V2, V3 and V5 is set within a range that satisfies a given expression including V1 to V5 except the one.

Preferably, if values of V1, V3, V4 and V5 are arbitrarily provided, V2 is set within a range that satisfies a (No. 1) expression.

$$\frac{-0.8}{2\ C22}(C2+C12\ V1+C23\ V3+C24\ V4+C25\ V5) \le V2 \le \frac{-1.2}{2\ C22}(C2+C12\ V1+C23\ V3+C24\ V4+C25\ V5) \quad \text{[No. 1]}$$

where coefficients Cx are values shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915 |

Preferably, if values of V1, V2, V4 and V5 are arbitrarily provided, V3 is set within a range that satisfies a (No. 2) expression.

$$\frac{-0.8}{2\ C33}(C3+C13\ V1+C23\ V2+C34\ V4+C35\ V5) \le V3 \le \frac{-1.2}{2\ C33}(C3+C13\ V1+C23\ V2+C34\ V4+C35\ V5) \quad \text{[No. 2]}$$

where coefficients Cx are values shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915 |

Preferably, if values of V1, V2, V3 and V4 are arbitrarily provided, V5 is set within a range that satisfies a (No. 3) expression.

$$\frac{-0.8}{2\ C55}(C5+C15\ V1+C25\ V2+C35\ V3) \le V5 \le \frac{-1.2}{2\ C55}(C5+C15\ V1+C25\ V2+C35\ V3) \quad \text{[No. 3]}$$

where coefficients Cx are values shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915 |

Preferably, if values of V1, V4 and V5 are arbitrarily provided, V2 and V3 are set within ranges that satisfy the (No. 1) and (No. 2) expressions, respectively.

$$\frac{-0.8}{2\ C22}(C2+C12\ V1+C23\ V3+C24\ V4+C25\ V5) \le V2 \le \frac{-1.2}{2\ C22}(C2+C12\ V1+C23\ V3+C24\ V4+C25\ V5) \quad \text{[No. 1]}$$

$$\frac{-0.8}{2\ C33}(C3+C13\ V1+C23\ V2+C34\ V4+C35\ V5) \le V3 \le \frac{-1.2}{2\ C33}(C3+C13\ V1+C23\ V2+C34\ V4+C35\ V5) \quad \text{[No. 2]}$$

where coefficients Cx are values shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915 |

Preferably, if values of V1, V2 and V4 are arbitrarily provided, V3 and V5 are set within ranges that satisfy the (No. 2) and (No. 3) expressions, respectively.

$$\frac{-0.8}{2\ C33}(C3+C13\ V1+C23\ V2+C34\ V4+C35\ V5) \le V3 \le \frac{-1.2}{2\ C33}(C3+C13\ V1+C23\ V2+C34\ V4+C35\ V5) \quad \text{[No. 2]}$$

$$\frac{-0.8}{2\ C55}(C5+C15\ V1+C25\ V2+C35\ V3) \le V5 \le \frac{-1.2}{2\ C55}(C5+C15\ V1+C25\ V2+C35\ V3) \quad \text{[No. 3]}$$

where coefficients Cx are values shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915 |

Preferably, if values of V1, V3 and V4 are arbitrarily provided, V2 and V5 are set within ranges that satisfy the (No. 1) and (No. 3) expressions, respectively.

$$\frac{-0.8}{2\ C22}(C2+C12\ V1+C23\ V3+C24\ V4+C25\ V5) \le V2 \le \frac{-1.2}{2\ C22}(C2+C12\ V1+C23\ V3+C24\ V4+C25\ V5) \quad \text{[No. 1]}$$

-continued $$\frac{-0.8}{2\ C55}(C5+C15\ V1+C25\ V2+C35\ V3) \le V5 \le \frac{-1.2}{2\ C55}(C5+C15\ V1+C25\ V2+C35\ V3) \quad \text{[No. 3]}$$

where coefficients Cx are values shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915 |

Preferably, if values of V1 and V4 are arbitrarily provided, V2, V3 and V5 are set within ranges that satisfy the (No. 1), (No. 2) and (No. 3) expressions, respectively.

$$\frac{-0.8}{2\ C22}(C2+C12\ V1+C23\ V3+C24\ V4+C25\ V5) \le V2 \le \frac{-1.2}{2\ C22}(C2+C12\ V1+C23\ V3+C24\ V4+C25\ V5) \quad \text{[No. 1]}$$

$$\frac{-0.8}{2\ C33}(C3+C13\ V1+C23\ V2+C34\ V4+C35\ V5) \le V3 \le \frac{-1.2}{2\ C33}(C3+C13\ V1+C23\ V2+C34\ V4+C35\ V5) \quad \text{[No. 2]}$$

$$\frac{-0.8}{2\ C55}(C5+C15\ V1+C25\ V2+C35\ V3) \le V5 \le \frac{-1.2}{2\ C55}(C5+C15\ V1+C25\ V2+C35\ V3) \quad \text{[No. 3]}$$

where coefficients Cx are values shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |

TABLE 1-continued

| | |
|---|---|
| C35 | 197.8195 |
| C44 | 8831.846 |
| C55 | −129.915 |

Preferably, in the above constitution, the external diameter V1 of each of the heat-transfer tubes is set within a range that satisfies a (No. 4) expression.

$$4[\text{mm}] \leq V1 \leq 8[\text{mm}] \quad \text{[No. 4]}$$

Preferably, in the above constitution, a carbon dioxide refrigerant flows through the heat-transfer tubes.

The heat pump of the present invention uses the heat exchanger having the above constitution as an evaporator of a refrigerating circuit.

Advantageous Effects of the Invention

According to the present invention, heat exchanger performance per unit weight in the heat exchanger can be enhanced to maximum or up to a level close to maximum. It is then possible to obtain sufficient heat exchange performance and reduce the heat exchanger in size and weight. Moreover, according to a preferred embodiment of the invention, the heat exchange amount per opening area and unit temperature difference in the heat exchanger can be maximized. It is then possible to further enhance the heat exchange performance and further reduce the heat exchanger in size and weight.

MODE FOR CARRYING OUT THE INVENTION

A mode for carrying out the invention will be described below in detail with reference to the attached drawings.

In a cooling system using a fin tube-type heat exchanger and a fan, the actual degree of cooling depends chiefly upon the constitution of the heat exchanger and the characteristics of the fan.

Figure 2:
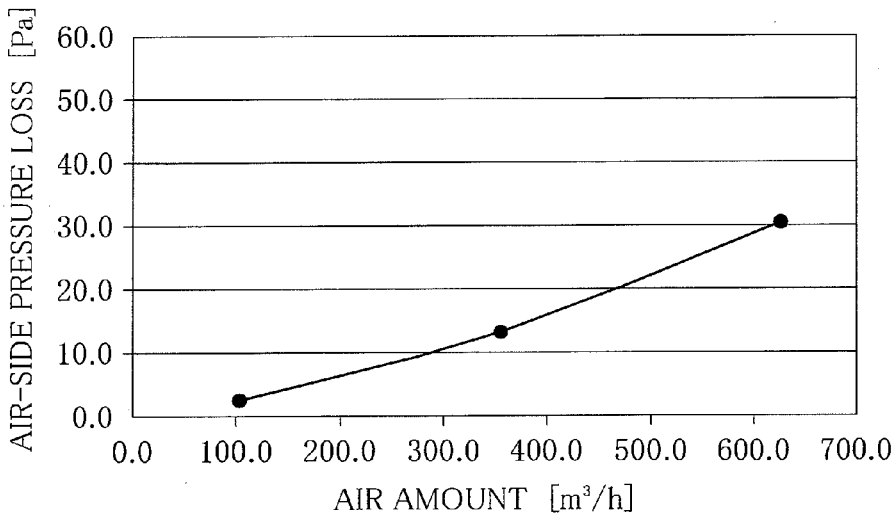
FIG. 2 shows relationship between air-side pressure loss and air volume in the fin tube-type heat exchanger.
Figure 3:
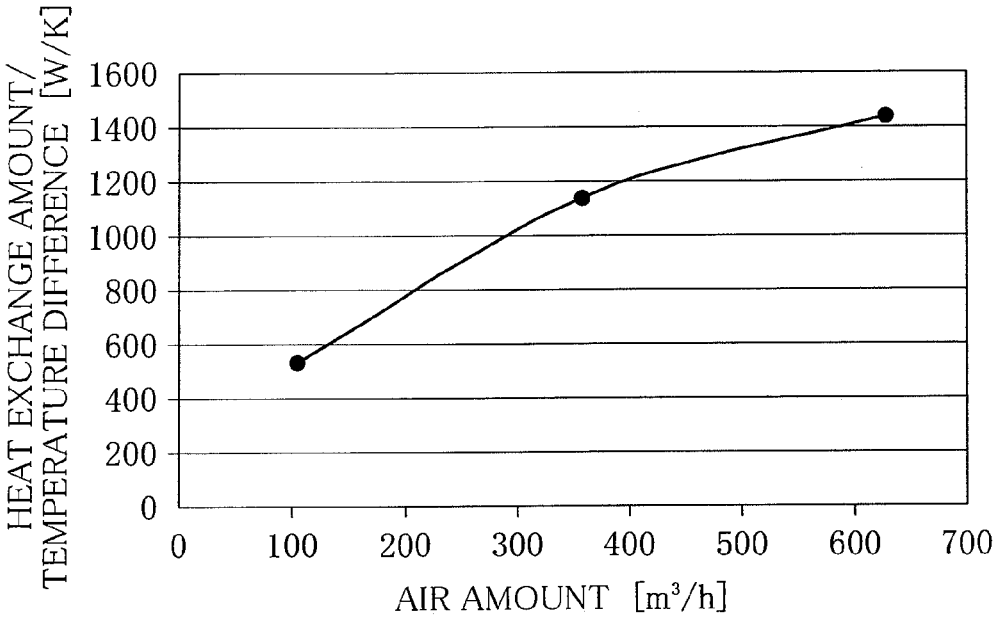
FIG. 3 shows relationship between heat exchange amount per unit temperature difference and air volume in the fin tube-type heat exchanger.

Relationship between air-side pressure loss and air volume in a certain fin tube-type heat exchanger is found as shown in FIG. 2. Relationship between heat exchange amount per unit temperature difference Q[W/K] and air volume is found as shown in FIG. 3. The heat exchange amount per unit temperature difference Q[W/K] is obtained as below.

Figure 1:
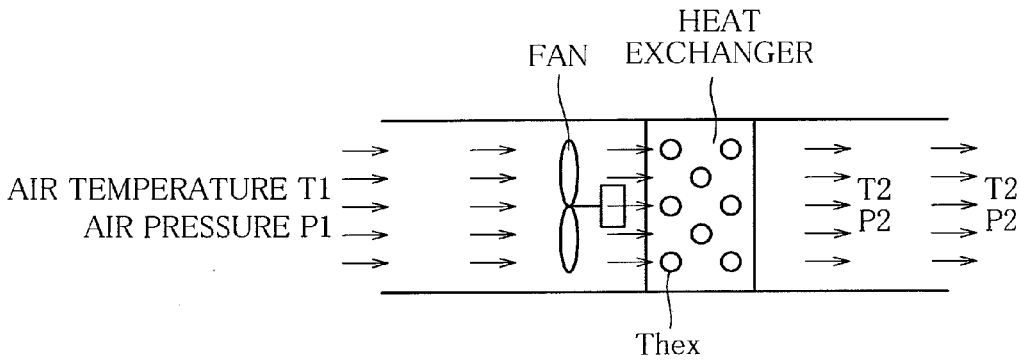
FIG. 1 is a schematic view of a cooling system using a fin tube-type heat exchanger and a fan.

Assuming that air temperature is changed from T1[K] to T2[K] when air passes through the heat exchanger (temperature Thex) at air volume V[$m^3$/h] as shown in FIG. 1, thermal energy transfer amount from the heat exchanger to air per unit time, namely, heat exchange amount q[W], is represented by a (No. 5) expression, where air density is n[kg/$m^3$], and specific heat is C[J/(kg·K)].

$$q = nC\frac{V}{3600}(T2 - T1) \quad \text{[No. 5]}$$

A result obtained by dividing q by an absolute value of temperature difference between inflow air and the heat exchanger is the heat exchange amount per unit temperature Q[W/K], that is, a (No. 6) expression.

$$Q = nC\frac{V}{3600}\frac{T2 - T1}{|Thex - T1|} \quad \text{[No. 6]}$$

For example, if the heat exchanger is one for heating, it is only necessary to increase the heat-exchanger temperature Thex to be higher than inflow air temperature T1 to make air temperature T2 after air passes through the heat exchanger higher than the inflow air temperature T1 before air passes through the heat exchanger. In short, q can be increased by increasing the temperature difference between the inflow air and the heat exchanger |Thex−T1|. Q represents the heat exchange performance reflecting not only |Thex−T1| but also the advantages of configuration of the heat exchanger by dividing q by |Thex−T1|.

Figure 4:
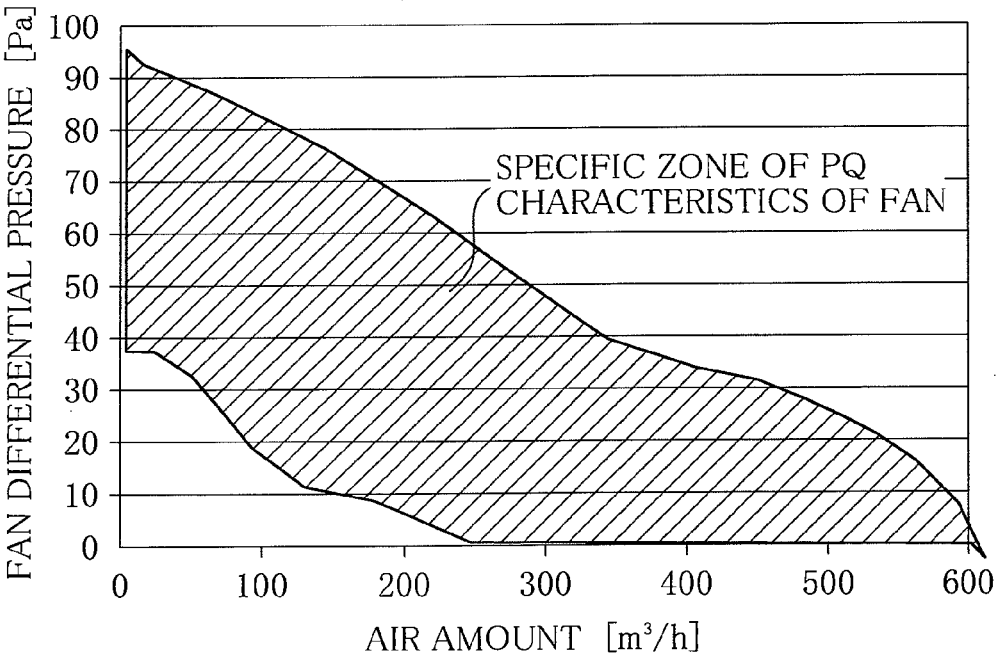
FIG. 4 shows a specific zone of PQ characteristics of the fan.
Figure 5:
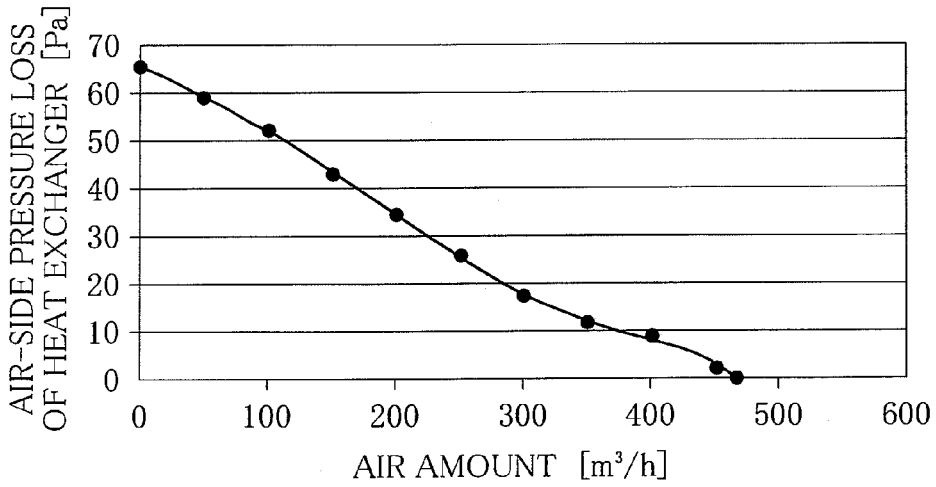
FIG. 5 shows the PQ characteristics of the fan.

How much air amount [$m^3$/h] is obtained when air is supplied with the fan placed in front (or at the rear) of the heat exchanger as shown in FIG. 1 depends upon the combination of the fan characteristics and the heat exchanger configuration. For example, if the fan having the characteristics (FIG. 5) included in a "specific zone of PQ characteristics of the fan" shown in FIG. 4 is combined with the heat exchanger having the characteristics of pressure loss and air amount shown in FIG. 2, the air amount to be obtained is air amount V at the intersection of the lines indicative of both the characteristics shown in FIG. 6. If the air amount V is found, the actual heat exchange amount per unit temperature difference Q[W/K] can be calculated from the characteristics shown in FIG. 3, which has already been obtained. If the heat exchanger temperature Thex and the inflow air temperature T1 are provided, it is possible to calculate the heat exchange amount q[W] and the temperature T2 of the air discharged from the heat exchanger. It can be considered that the inventions disclosed in Patent Documents 1 and 2 are for increasing q[W] or Q[W/K].

The most lightweight and high-performance heat exchanger is one having the highest heat exchange performance per unit weight.

Therefore, a result obtained by further dividing Q[W/K] by the weight of the heat exchanger [kg] is indicated as Q'[W/(kg·K)], namely, a (No. 7) expression, and used as an index of the heat exchange performance per unit weight.

$$Q' = \frac{Q}{M} \quad \text{[No. 7]}$$

Weight M[kg] is the heat exchanger's weight per unit opening area and per number of heat-transfer tube lines.

FIG. 4 shows the specific zone of PQ characteristics of the fan. Concerning fan performance, air amount is determined by rotational speed, so that the rotational speed is needed as a selective parameter of fan performance. On the other hand, although the air amount is increased by improving the fan rotational speed, a noise problem takes place. If the rotational speed is reduced to lower noises, the air amount is decreased. On this account, the specific zone of PQ characteristics of FIG. 4 is a zone that is defined by high and low rotational speeds. A single fan (PQ characteristic) included in the specific zone is selected.

Figure 7:
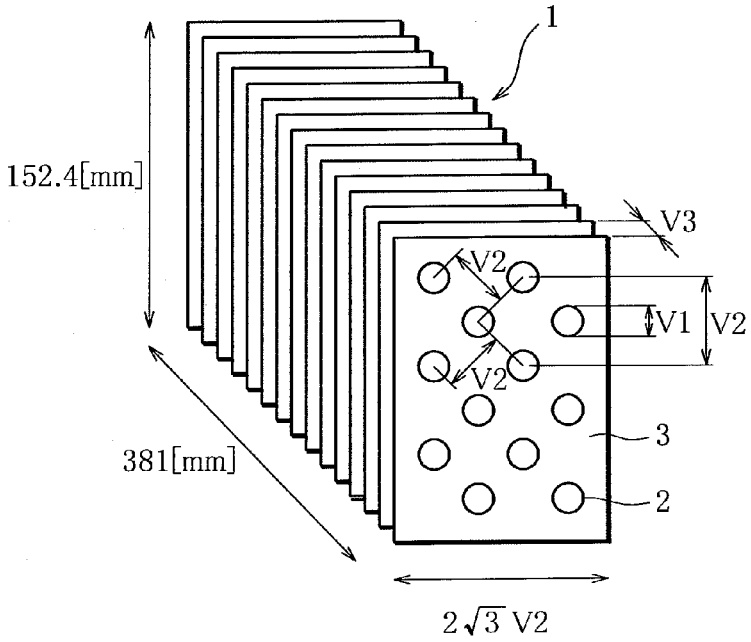
FIG. 7 is a perspective view of the fin tube-type heat exchanger.
Figure 8:
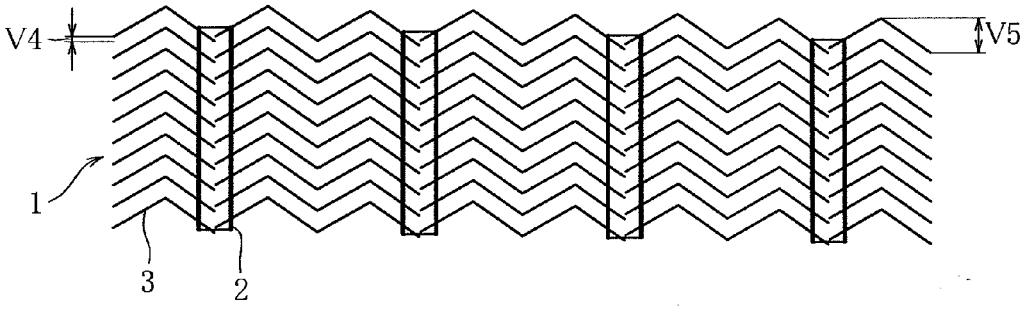
FIG. 8 is a plan view of the fin tube-type heat exchanger.

Concerning the fin tube-type heat exchanger, there is provided a heat exchanger 1 having a plurality of heat-transfer tubes 2 arranged at radial intervals so that an equilateral triangle is formed by lines connecting the centers of the heat-transfer tubes 2 located vertically and anteroposteriorly adjacent to each other; and a plurality of heat-transfer corrugated fins 3 arranged at intervals in an axial direction of the heat-transfer tubes. The heat exchanger 1 is so configured that a combination of the heat-transfer tube's external diameter V1 [mm], the heat-transfer tube pitch V2 [mm], the fin pitch V3 [mm], the fin plate thickness V4 [mm] and the corrugate height V5 [mm] is specified (see FIGS. 7 and 8 as for the parameters). To be specific, a vertical distance between every two adjacent heat-transfer tubes 2 is V2, and the entire vertical length of a fin plate is, for example, 152.4 [mm] as shown in FIG. 7. An anteroposterior distance between every two adjacent heat-transfer tubes 2 is $(\sqrt{3}V2)/2$. Distance from each anteroposterior end of the fin plate to the heat-transfer tubes 2 is a half of $(\sqrt{3}V2)/2$, that is, $(\sqrt{3}V2)/4$. The entire anteroposterior length of the fin plate is $2\sqrt{3}V2$ as shown in FIG. 7.

Figure 6:
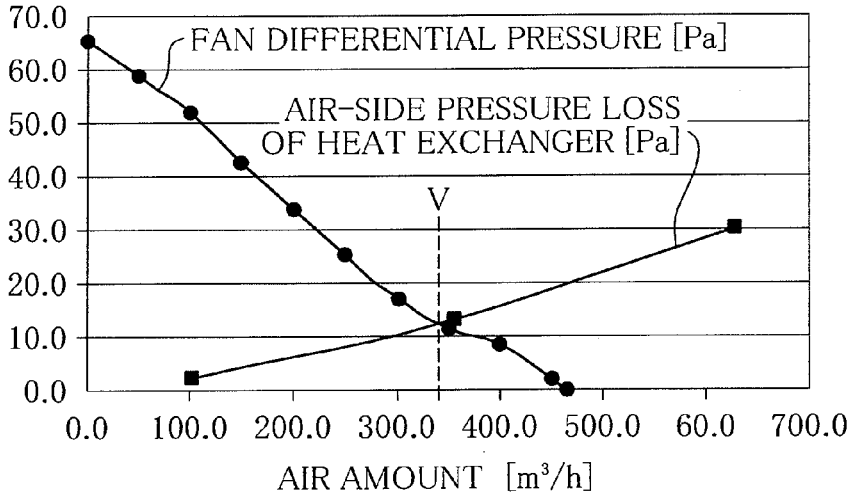
FIG. 6 shows an intersection of a line indicative of relationship between the volume of air passing between heat-transfer corrugated fins during air supply and pressure loss and a line indicative of the PQ characteristics of the fan.
Figure 9:
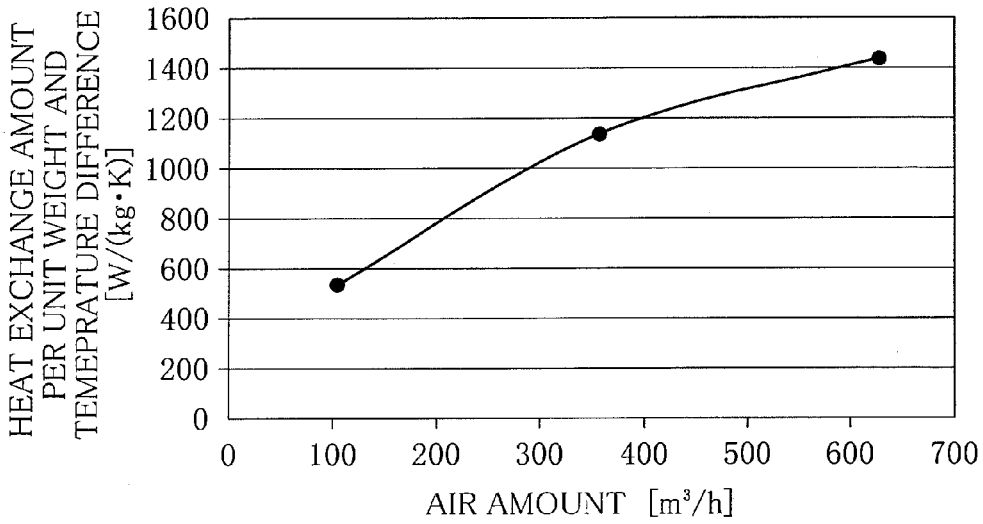
FIG. 9 shows relationship between heat exchange amount Q' per unit weight and unit temperature difference and air volume in the fin tube-type heat exchanger.

With respect to the heat exchanger, the relationship between pressure loss and air amount as shown in FIG. 2, and the characteristics of Q'[W/(kg·K)] and the air amount as shown in FIG. 9 are measured. The air amount to be provided by thus combining the fan and the heat exchanger is obtained as shown in FIG. 6, and Q' corresponding to this air amount is calculated. Such work is carried out with respect to combinations of a number of fans and a number of heat exchanger configurations included in the specific zone of PQ characteristics of the fan.

On the basis of a large amount of the data obtained, Q' is approximately expressed by a (No. 8) expression in the form of a function of the heat-transfer tube's external diameter V1, the heat-transfer tube pitch V2, the fin pitch V3, the fin plate thickness V4, and the corrugate height V5.

$$\begin{aligned} Q' = {} & C0 + C1V1 + C2V2 + C3V3 + C4V4 + C5V5 + C11V1^2 + \\ & C12V1V2 + C13V1V3 + C14V1V4 + C15V1V5 + \\ & C22V2^2 + C23V2V3 + C24V2V4 + C25V2V5 + C33V3^2 + \\ & C34V3V4 + C35V3V5 + C44V4^2 + C45V4V5 + C55V5^2 \end{aligned} \quad \text{[No. 8]}$$

Since the term of C45V4V5 is a very small value, this term can be omitted from the (No. 8) expression and will be therefore omitted. A (No. 9) expression holds when the term of C45V4V5 is omitted.

$$\begin{aligned} Q' = {} & C0 + C1\ V1 + C2\ V2 + C3\ V3 + C4\ V4 + \\ & C5\ V5 + C11\ V1^2 + C12\ V1\ V2 + C13\ V1\ V3 + \\ & C14\ V1\ V4 + C15\ V1\ V5 + C22\ V2^2 + \\ & C23\ V2\ V3 + C24\ V2\ V4 + C25\ V2\ V5 + C33\ V3^2 + \\ & C34\ V3\ V4 + C35\ V3\ V5 + C44\ V4^2 + C55\ V5^2 \end{aligned} \quad \text{[No. 9]}$$

where coefficients C0, C1, C2, C3, . . . and C55 in the (No. 9) expression are coefficients obtained by a response surface method as shown in (TABLE 1).

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915 |

Figure 10:
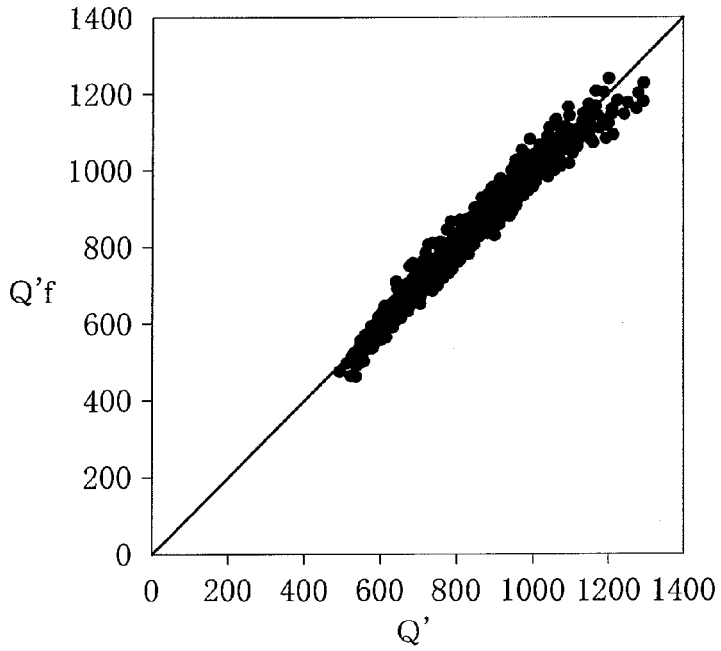
FIG. 10 shows relationship between a value of an approximate expression and an actual value, pertinent to the heat exchange amount Q' per unit weight and unit temperature difference in the fin tube-type heat exchanger.
Figure 11:
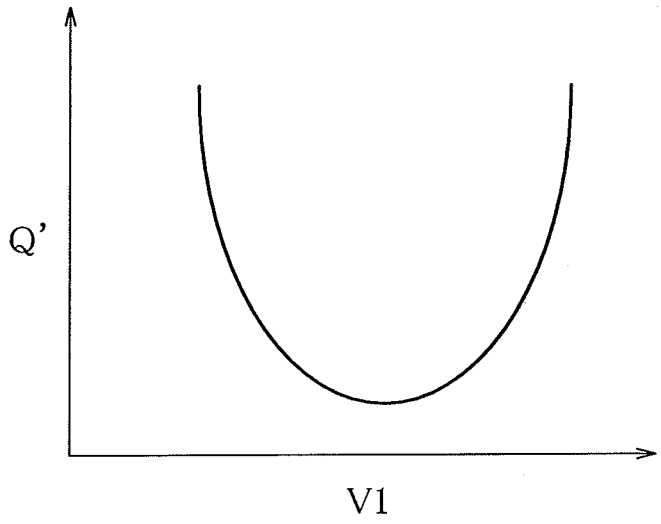
FIG. 11 shows relationship between the heat exchange amount Q' per unit weight and unit temperature difference and an external diameter of a heat-transfer tube in the fin tube-type heat exchanger.

In FIG. 10, a horizontal axis indicates the data of actual Q', and a vertical axis indicates Q'f, that is, a value obtained by calculating Q' corresponding to the data through the (No. 9) expression. The data is distributed substantially along a line of Q'=Q'f, and thus shows that the (No. 9) expression is appropriate.

Figure 12:
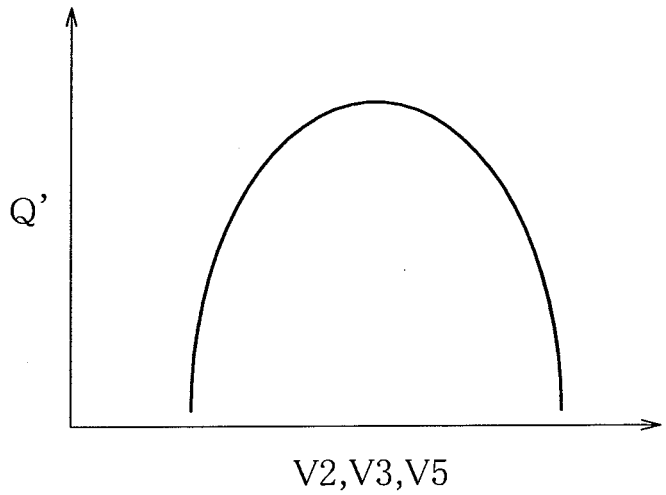
FIG. 12 shows relationship between the heat exchange amount Q' per unit weight and unit temperature difference and a vertical pitch V2 of the heat-transfer tube, a fin pitch V3 of heat-transfer corrugated fins, and a corrugate height V5 of the heat-transfer corrugated fins, in the fin tube-type heat exchanger.

The coefficient C11 that is included in Q' expressed in the (No. 9) expression is a coefficient of the square of V1. Since C11>0, Q' is shown in a downwardly convex shape relative to V1 (external diameter of the heat-transfer tube). This means that V1 that maximizes Q', or an optimum value of V1, does not exist. Observation reveals that only the heat-transfer tube pitch V2, the fin pitch V3, and the corrugate height V5 have optimum values that maximize Q'. As to V2, V3 and V5, therefore, Q' is shown in an upwardly convex shape as shown in FIG. 12.

The optimum values of V2, V3 and V5 are obtained in the following manner. As to V2, Q' reaches a maximum at a vertex of the convex where slope is zero as shown in FIG. 12. This can be expressed by a (No. 10) expression.

$$\frac{\partial Q'}{\partial V2} = 0 \quad \text{[No. 10]}$$

If the (No. 10) expression is applied to the (No. 9) expression, a (No. 11) expression is established.

$$C2+C12V1+2C22V2+C23V3+C24V4+C25V5=0 \quad \text{[No. 11]}$$

This is a relational expression satisfied by V1, V2, . . . V5 when V2 reaches an optimum value. If the optimum value of V2 is calculated through this expression, the heat-transfer tube pitch V2 of the heat exchanger, at which the heat exchange amount Q' reaches a maximum, can be determined.

The same is true on V3. The maximum Q' reaches a maximum at the vertex of the convex where slope is zero. This can be expressed by a (No. 12) expression.

$$\frac{\partial Q'}{\partial V3} = 0 \quad \text{[No. 12]}$$

If the (No. 12) expression is applied to the (No. 9) expression, a (No. 13) expression is established.

$$C3+C13V1+C23V2+2C33V3+C34V4+C35V5=0 \quad \text{[No. 13]}$$

This is a relational expression satisfied by V1, V2, . . . and V5 when V3 reaches an optimum value. If the optimum value of V3 is calculated through this expression, the fin pitch V3 of the heat exchanger, at which the heat exchange amount Q' reaches a maximum, can be determined.

The same is true on V5. Q' reaches a maximum at the vertex of the convex where slope is zero. This can be expressed by a (No. 14) expression.

$$\frac{\partial Q'}{\partial V5} = 0 \quad \text{[No. 14]}$$

If the (No. 14) expression is applied to the (No. 9) expression, a (No. 15) expression is established.

$$C5+C15V1+C25V2+C25V3+2C55V5=0 \quad \text{[No. 15]}$$

This is a relational expression satisfied by V1, V2, . . . and V5 when V5 reaches an optimum value. If the optimum value of V5 is calculated through this expression, the corrugate height V5 of the heat exchanger, at which the heat exchange amount Q' reaches a maximum, can be determined.

According to the (No. 8) expression, the (No. 15) expression actually includes a term of C45V4. Based upon the (No. 9) expression, however, the term of C45V4 is omitted. Likewise, the term of C45V4 will be omitted from (No. 16), (No. 17), (No. 18), (No. 22) and (No. 24) expressions.

To set V2, V3 and V5 to optimum values and maximize Q', V2, V3 and V5 have to be determined to satisfy the (No. 11), (No. 13) and (No. 15) expressions all at the same time. In short, the simultaneous linear equation, namely, the (No. 16) expression, needs to be solved.

$$\begin{pmatrix} 2\,C22 & C23 & C25 \\ C23 & 2\,C33 & C35 \\ C25 & C35 & 2\,C55 \end{pmatrix}\begin{pmatrix} V2 \\ V3 \\ V5 \end{pmatrix} = \begin{pmatrix} -C2-C12\,V1-C24\,V4 \\ -C3-C13\,V1-C34\,V4 \\ -C5-C15\,V1 \end{pmatrix} \quad \text{[No. 16]}$$

However, the values of V1 and V4 need to be provided. In view of designing, this means that when V1 and V4 are first arbitrarily decided, V2, V3 and V5 that maximize Q' are determined by the (No. 16) expression.

In the foregoing description, V1 and V4 can be arbitrarily decided, and the optimum V2, V3 and V5 are accordingly calculated. However, in the actual designing, not only V1 and V4 but also V2 is occasionally determined due to some design restriction. In such a case, the optimum value of V2 cannot be selected. As for V3 and V5, however, optimum values can be calculated. In this case, the (No. 13) and (No. 15) expressions are simultaneously solved. In other words, V3 and V5 are determined by solving the simultaneous linear equation, namely, the (No. 17) expression.

$$\begin{pmatrix} 2\,C33 & C35 \\ C35 & 2\,C55 \end{pmatrix}\begin{pmatrix} V3 \\ V5 \end{pmatrix} = \begin{pmatrix} -C3-C13\,V1-C23\,V2-C34\,V4 \\ -C5-C15\,V1-C25\,V2 \end{pmatrix} \quad \text{[No. 17]}$$

Likewise, if not only V1 and V4 but also V3 is beforehand determined, the (No. 18) expression needs to be solved through the (No. 11) and (No. 15) expressions to calculate the optimum values of V2 and V5.

$$\begin{pmatrix} 2\,C22 & C25 \\ C25 & 2\,C55 \end{pmatrix}\begin{pmatrix} V2 \\ V5 \end{pmatrix} = \begin{pmatrix} -C2-C12\,V1-C23\,V3-C24\,V4 \\ -C5-C15\,V1-C35\,V3 \end{pmatrix} \quad \text{[No. 18]}$$

If not only V1 and V4 but also V5 is beforehand determined, the (No. 19) expression needs to be solved through the (No. 11) and (No. 13) expressions to calculate the optimum values of V2 and V3.

$$\begin{pmatrix} 2\,C22 & C23 \\ C23 & 2\,C33 \end{pmatrix}\begin{pmatrix} V2 \\ V3 \end{pmatrix} = \begin{pmatrix} -C2-C12\,V1-C24\,V4-C25\,V5 \\ -C3-C13\,V1-C34\,V4-C35\,V5 \end{pmatrix} \quad \text{[No. 19]}$$

If there are more severe design restrictions, and all but V2 are beforehand determined, V2 needs to be determined from the (No. 11) expression to optimize V2 at least. This can be expressed by a (No. 20) expression.

$$V2 = \frac{-1}{2\,C22}(C2+C12\,V1+C23\,V3+C24\,V4+C25\,V5) \quad \text{[No. 20]}$$

Likewise, a (No. 21) expression is employed to optimize V3 only.

$$V3 = \frac{-1}{2\ C33}(C3 + C13\ V1 + C23\ V2 + C34\ V4 + C35\ V5) \quad \text{[No. 21]}$$

To optimize V5 only, a (No. 22) expression is employed.

$$V5 = \frac{-1}{2\ C55}(C5 + C15\ V1 + C25\ V2 + C35\ V3) \quad \text{[No. 22]}$$

Figure 13:
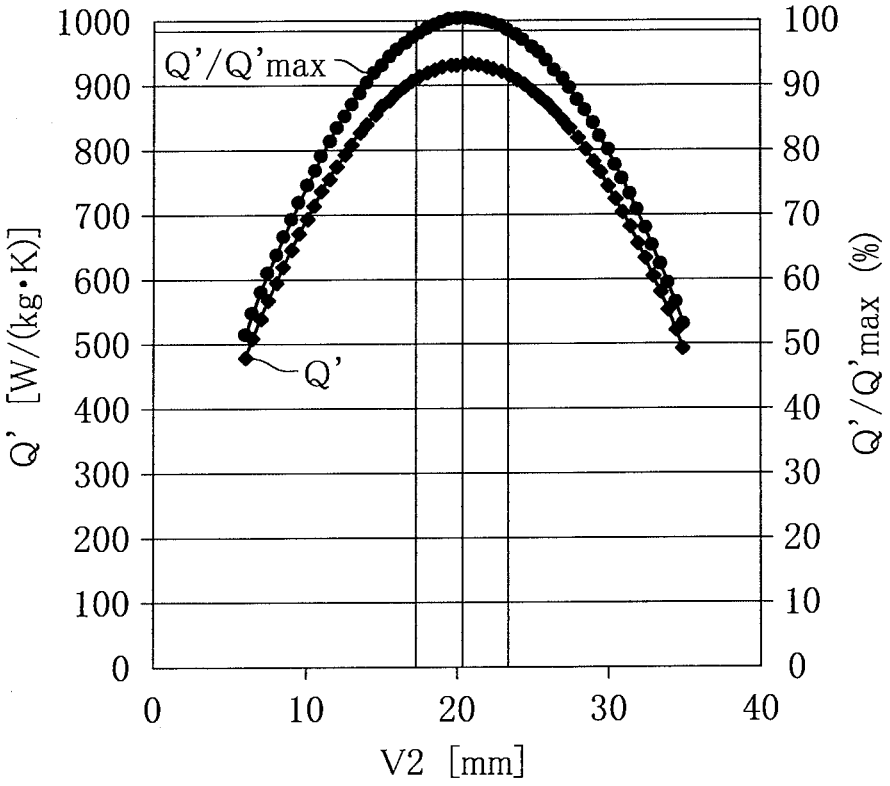
FIG. 13 shows a range of V2 when Q' reaches 98 percent of a maximum value of Q'.
Figure 14:
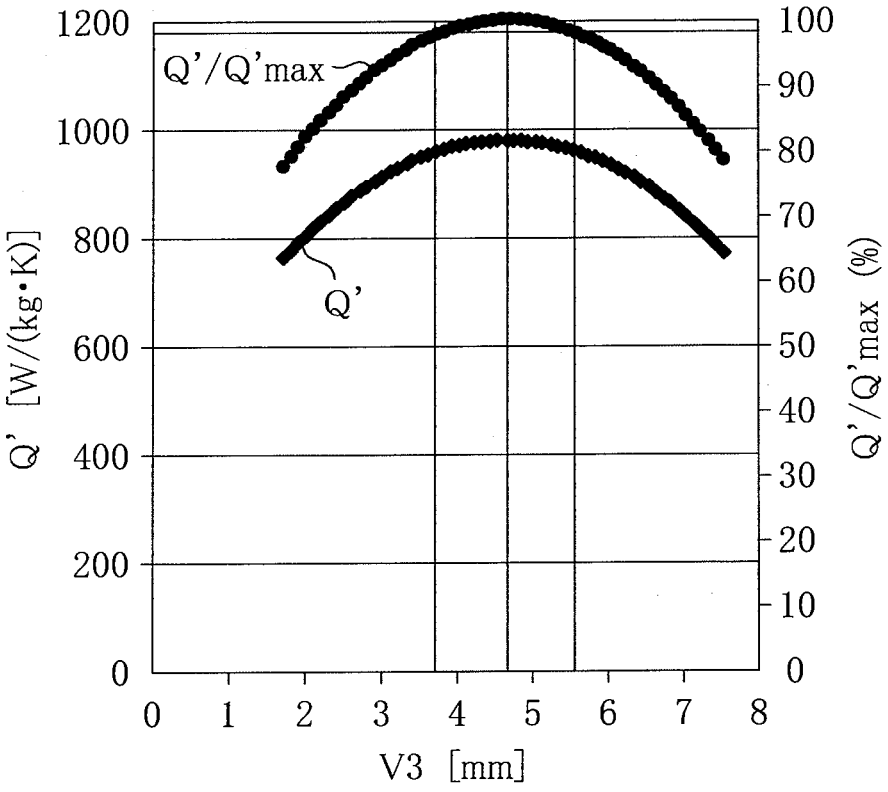
FIG. 14 shows a range of V3 when Q' is 98 percent of the maximum value of Q'.
Figure 15:
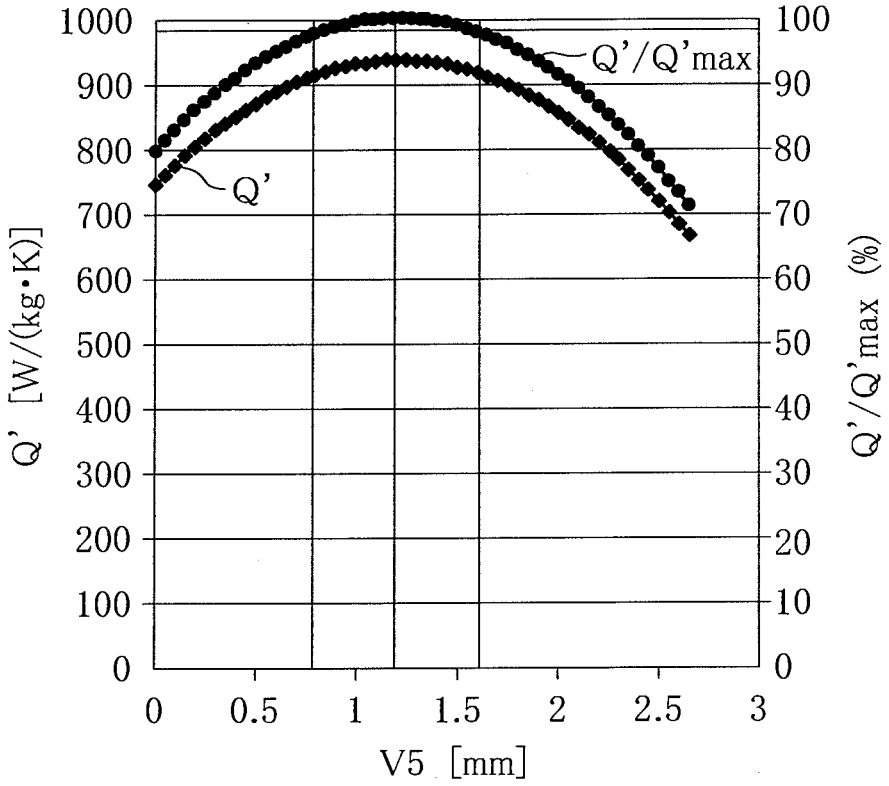
FIG. 15 shows a range of V5 when Q' is 98 percent of the maximum value of Q'.

The above descriptions are about how to establish the relational expressions to be satisfied by V2, V3 and V5 when Q' reaches a maximum. However, for example, if V2 is indicated by the horizontal axis, and Q' by the vertical axis, a graph shown in FIG. 13 is obtained. Similarly, if V3 and V5 are indicated by horizontal axes, graphs are obtained as shown in FIGS. 14 and 15, respectively. As far as V2 is concerned, even if the (No. 20) expression is not satisfied, when V2 falls in a range of from 0.8 to 1.2 times of the optimum value thereof, that is, in a range indicated by a (No. 23) expression, it is possible to obtain Q' that is 98 percent of the maximum value of Q' or higher.

$$\frac{-0.8}{2\ C22}(C2 + C12\ V1 + C23\ V3 + C24\ V4 + C25\ V5) \le V2 \le \frac{-1.2}{2\ C22}(C2 + C12\ V1 + C23\ V3 + C24\ V4 + C25\ V5) \quad \text{[No. 23]}$$

The same is true on V3 and V5. If V3 and V5 fall in ranges indicated by (No. 24) and (No. 25) expressions, it is possible to obtain Q' that is 98 percent of the maximum value of Q' or higher.

$$\frac{-0.8}{2\ C55}(C5 + C15\ V1 + C25\ V2 + C35\ V3) \le V5 \le \frac{-1.2}{2\ C55}(C5 + C15\ V1 + C25\ V2 + C35\ V3) \quad \text{[No. 24]}$$

$$\frac{-0.8}{2\ C33}(C3 + C13\ V1 + C23\ V2 + C34\ V4 + C35\ V5) \le V3 \le \frac{-1.2}{2\ C33}(C3 + C13\ V1 + C23\ V2 + C34\ V4 + C35\ V5) \quad \text{[No. 25]}$$

(TABLE 2) shows specific examples of combinations of optimum parameters, which are obtained by the foregoing method.

TABLE 2

| No. | V1 [mm] | V2 [mm] | V3 [mm] | V4 [mm] | V5 [mm] | Q' [W/(kg · K)] |
|---|---|---|---|---|---|---|
| 1 | 4.5 | 22.35 | 1.51 | 0.2 | 0.02 | 828.2 |
| 2 | 4.5 | 15.28 | 0.73 | 0.3 | 0.15 | 787.2 |
| 3 | 5 | 29.41 | 2.88 | 0.1 | 0.17 | 1231.1 |
| 4 | 5 | 22.35 | 2.1 | 0.2 | 0.3 | 844.5 |
| 5 | 5 | 15.28 | 1.31 | 0.3 | 0.44 | 834.2 |
| 6 | 5 | 8.22 | 0.53 | 0.4 | 0.58 | 1200.2 |
| 7 | 6 | 29.41 | 4.05 | 0.1 | 0.74 | 1140.9 |
| 8 | 6 | 22.34 | 3.26 | 0.2 | 0.87 | 815.9 |
| 9 | 6 | 15.28 | 2.48 | 0.3 | 1.01 | 867.0 |
| 10 | 6 | 8.21 | 1.7 | 0.4 | 1.15 | 1294.4 |
| 11 | 7 | 29.4 | 5.22 | 0.1 | 1.31 | 969.0 |
| 12 | 7 | 22.34 | 4.43 | 0.2 | 1.45 | 705.4 |
| 13 | 7 | 15.27 | 3.65 | 0.3 | 1.58 | 818.0 |
| 14 | 7 | 8.21 | 2.87 | 0.4 | 1.72 | 1306.8 |
| 15 | 8 | 29.4 | 6.38 | 0.1 | 1.88 | 715.4 |

TABLE 2-continued

| No. | V1 [mm] | V2 [mm] | V3 [mm] | V4 [mm] | V5 [mm] | Q' [W/(kg · K)] |
|---|---|---|---|---|---|---|
| 16 | 8 | 22.33 | 5.6 | 0.2 | 2.02 | 513.2 |
| 17 | 8 | 15.27 | 4.82 | 0.3 | 2.15 | 687.2 |
| 18 | 8 | 8.2 | 4.03 | 0.4 | 2.29 | 1237.5 |

According to the present invention, if the heat-transfer tube's external diameter V1, the vertical pitch V2 of the heat-transfer tubes, the fin pitch V3 of the heat-transfer corrugated fins, the fin plate thickness V4 of the heat-transfer corrugated fins, and the corrugate height V5 of the heat-transfer corrugated fins are determined so as to satisfy the given expression, it is possible to obtain a fin tube-type heat exchanger that is compact and lightweight, and has the highest heat exchange performance per unit weight.

The heat-transfer tubes of the heat exchanger of the present embodiment are arrayed at radial intervals in vertical and anteroposterior directions and also arranged so that an equilateral triangle is formed by lines connecting the centers of the heat-transfer tubes located vertically and anteroposteriorly adjacent to each other. It is also possible to arrange the heat-transfer tubes to form an isosceles triangle whose base is a line connecting every two vertically adjacent heat-transfer tubes, and to set a pitch of two anteroposteriorly adjacent heat-transfer tubes (pitch corresponding to a hypotenuse of the isosceles triangle) to be 80 to 110 percent of a pitch of two vertically adjacent heat-transfer tubes. It has already been confirmed that, in the above-described case, the heat exchanger maintains the heat exchange performance per unit weight which is as high as in the case where the equilateral triangle is formed. In other words, the equilateral triangle of the invention includes the isosceles triangle in which the pitch of two anteroposteriorly adjacent heat-transfer tubes is 80 to 110 percent of the pitch of two vertically adjacent heat-transfer tubes.

It has also been confirmed that, according to the present invention, the heat exchange performance per unit weight can be maximized when the heat-transfer tube's external diameter V1 is in a range of from 4 (mm) to 8 (mm).

Figure 16:
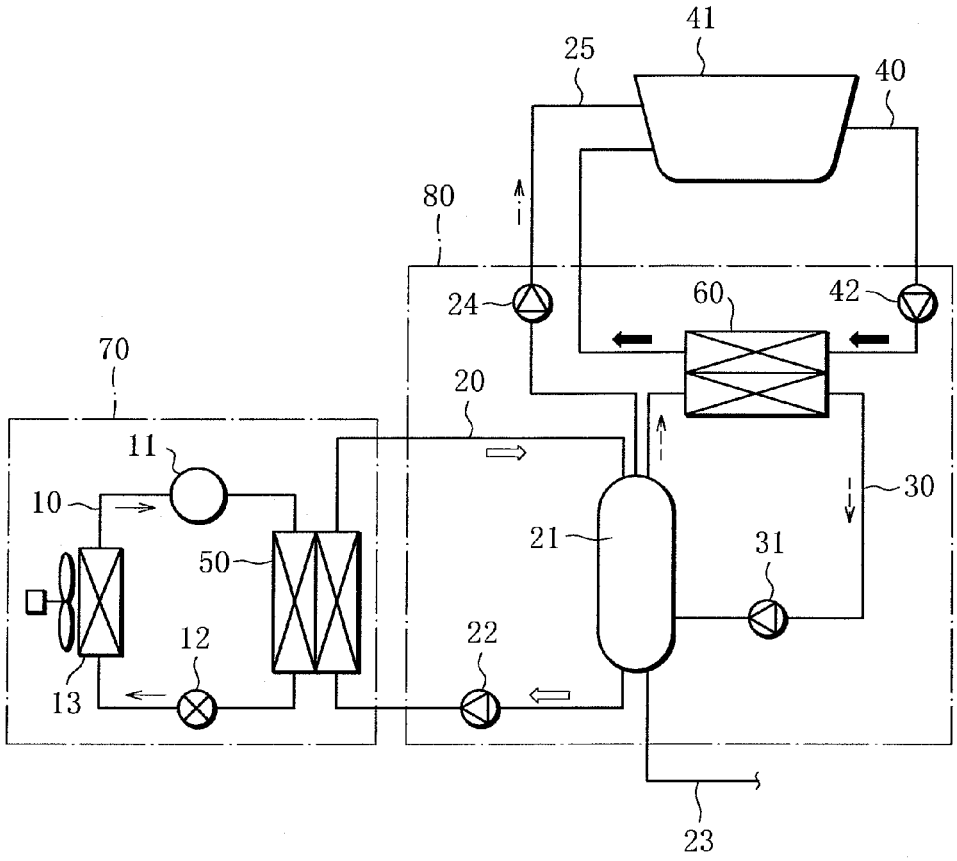
FIG. 16 is a schematic configuration view of a heat pump-style water heater using the heat exchanger of the present invention.

A heat pump-style water heater shown in FIG. 16 uses the heat exchanger of the invention as an evaporator of a refrigerating circuit.

In FIG. 16, the heat pump-style water heater includes a refrigerating circuit 10 circulating a refrigerant; a first hot-water supply circuit 20 circulating water for hot-water supply; a second hot-water supply circuit 30 circulating water for hot-water supply; a bathtub circuit 40 circulating water for a bathtub; a first water heat exchanger 50 that makes heat exchange between the refrigerant of the refrigerating circuit 10 and the water for hot-water supply of the first hot-water supply circuit 20; and a second water heat exchanger 60 that makes heat exchange between the water for hot-water supply in the second hot-water supply circuit 30 and the water for a bathtub in the bathtub circuit 40.

The refrigerating circuit 10 is constructed by connecting a compressor 11, an expansion valve 12, an evaporator 13, and the first water heat exchanger 50 together. The refrigerant is circulated through the compressor 11, the first water heat exchanger 50, the expansion valve 12, the evaporator 13, and the compressor 11 in order. The heat exchanger of the invention is installed in the evaporator 13. The refrigerant used in the refrigerating circuit 10 is a carbon dioxide refrigerant.

The first hot-water supply circuit 20 is constructed by connecting a hot-water tank 21, a first pump 22, and the first water heat exchanger 50 together. The water for hot-water supply is circulated through the hot-water tank 21, the first pump 22, the first water heat exchanger 50, and the hot-water tank 21 in order. Connected to the hot-water tank 21 are a water-supply pipe 23 and the second hot-water supply circuit 30. The water for hot-water supply, which is supplied from the water-supply pipe 23, is circulated through the first hot-water supply circuit 20 via the hot-water tank 21. The hot-water tank 21 and a bathtub 41 are connected to each other via a flow path 25 provided with a second pump 24. The second pump 24 is used to supply the water for hot-water supply in the hot-water tank 21 into the bathtub 41.

The second hot-water supply circuit 30 is constructed by connecting the hot-water tank 21, a third pump 31, and a second water heat exchanger 60 together. The water for hot-water supply is circulated through the hot-water tank 21, the second water heat exchanger 60, the third pump 31 and the hot-water tank 21 in order.

The bathtub circuit 40 is constructed by connecting the bathtub 41, a fourth pump 42 and the second water heat exchanger 60 together. The water for a bathtub is circulated through the bathtub 41, the fourth pump 42, the second water heat exchanger 60 and the bathtub 41 in order.

The first water heat exchanger 50 is connected to the refrigerating circuit 10 and the first hot-water supply circuit 20, thereby making heat exchange between the refrigerant serving as a first heating medium that circulates through the refrigerating circuit 10 and the water for hot-water supply which serves as a second heating medium that circulates through the first hot-water supply circuit 20.

The second water heat exchanger 60 is connected to the second hot-water supply circuit 30 and the bathtub circuit 40, thereby making heat exchange between the water for hot-water supply in the second hot-water supply circuit 30 and the water for a bathtub in the bathtub circuit 40.

The water heater is formed mainly of a heating unit 70 equipped with the refrigerating circuit 10 and the first water heat exchanger 50, and a tank unit 80 equipped with the hot-water tank 21, the first pump 22, the second pump 24, the second hot-water supply circuit 30, the fourth pump 42 and the second water heat exchanger 60. The heating unit 70 and the tank unit 80 are connected to each other via the first hot-water supply circuit 20.

In the water heater thus configured, heat exchange is made between a high-temperature refrigerant in the refrigerating circuit 10 and the water for hot-water supply in the first hot-water supply circuit 20 by the first water heat exchanger 50. The water for hot-water supply, which is heated by the first water heat exchanger 50, is stored in the hot-water tank 21. The water for hot-water supply in the hot-water tank 21 is heat-exchanged with the water for a bathtub in the bathtub circuit 40 by the second water heat exchanger 60. The water for a bathtub, which is heated by the second water heat exchanger 60, is supplied into the bathtub 41.

Although the embodiment explains the case in which the heat exchanger of the invention is used as the evaporator 13 of the heat pump-style water heater, it does not necessarily so. The heat exchanger of the invention may be used as another heat exchanger, such as an evaporator for an automatic dispenser.

INDUSTRIAL APPLICABILITY

The invention enhances the heat exchange performance of the heat exchanger and reduces the heat exchanger in size and weight. The invention can therefore be widely used as a heat exchanger for air-conditioning, freezing, cold storage, hot-water supply, etc., and is also applicable especially as an evaporator of a refrigerating circuit for a heat pump-style water heater or an automatic dispenser using a carbon dioxide refrigerant.

EXPLANATION OF REFERENCE SIGNS

1 heat exchanger
2 heat-transfer tube
3 heat-transfer corrugated fin
13 evaporator

The invention claimed is:

1. A heat exchanger having a plurality of heat-transfer tubes arrayed at intervals in vertical and anteroposterior directions and arranged so that an equilateral triangle is formed by lines connecting respective centers of heat-transfer tubes located vertically and anteroposteriorly adjacent to each other; and a plurality of heat-transfer corrugated fins arranged at intervals in an axial direction of the heat-transfer tubes, wherein:

when an external diameter of each of the heat-transfer tubes is V1, a vertical pitch of the heat-transfer tubes is V2, a fin pitch of the heat-transfer corrugated fins is V3, a fin plate thickness of each of the heat-transfer corrugated fins is V4, and a corrugate height of the heat-transfer corrugated fins is V5, at least values of V1 and V4 are arbitrarily provided, and at least any one of values V2, V3 and V5 is set from the following relationships:

$$\frac{-0.8}{2C22}(C2+C12\ V1+C23\ V3+C24\ V4+C25\ V5) \le V2 \le \frac{-1.2}{2C22}(C2+C12\ V1+C23\ V3+C24\ V4+C25\ V5),$$

$$\frac{-0.8}{2C33}(C3+C13\ V1+C23\ V2+C34\ V4+C35\ V5) \le V3 \le \frac{-1.2}{2C33}(C3+C13\ V1+C23\ V2+C34\ V4+C35\ V5), \text{ and}$$

$$\frac{-0.8}{C55}(C5+C15\ V1+C25\ V2+C35\ V5) \le V5 \le \frac{-1.2}{2C22}(C5+C15\ V1+C25\ V2+C35\ V3),$$

where coefficients Cx are values shown in the following table:

TABLE 1

| | |
|---|---|
| C0 | 1274.598 |
| C1 | −468.304 |
| C2 | 85.77825 |
| C3 | 323.3443 |
| C4 | −4920.25 |
| C5 | 681.3158 |
| C11 | 14.17817 |
| C12 | 11.37856 |
| C13 | −53.7093 |
| C14 | 1110.834 |
| C15 | −82.8563 |
| C22 | −2.11724 |
| C23 | 3.432876 |
| C24 | −235.301 |
| C25 | −26.9782 |
| C33 | −25.3635 |
| C34 | −425.852 |
| C35 | 197.8195 |
| C44 | 8831.846 |
| C55 | −129.915. |

2. The heat exchanger according to claim 1, wherein the external diameter V1 of each of the heat-transfer tubes is set within a range that satisfies the following relationship:

$$4\ \text{mm} \leq V1 \leq 8\ \text{mm}.$$

3. The heat exchanger according to claim 1, wherein a carbon dioxide refrigerant flows through the heat-transfer tubes.

4. A heat pump characterized by using, as an evaporator of a refrigerating circuit, the heat exchanger claimed in claim 1.

* * * * *